US006933471B2

(12) United States Patent
Hamel et al.

(10) Patent No.: US 6,933,471 B2
(45) Date of Patent: Aug. 23, 2005

(54) CERAMIC IGNITERS WITH SEALED ELECTRICAL CONTACT PORTION

(75) Inventors: Scott M. Hamel, Wilton, NH (US); John D. Pietras, Sutton, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 0 days.

(21) Appl. No.: 10/222,768

(22) Filed: Aug. 17, 2002

(65) Prior Publication Data

US 2003/0080103 A1 May 1, 2003

Related U.S. Application Data

(60) Provisional application No. 60/313,113, filed on Aug. 18, 2001.

(51) Int. Cl.[7] ..... F23Q 7/00

(52) U.S. Cl. ..... 219/270; 219/260; 219/541; 361/264

(58) Field of Search ..... 219/270, 260, 219/541, 267; 174/50.61, 52.3, 52.2; 338/275, 322; 361/264–266; 431/66, 258, 263

(56) References Cited

U.S. PATENT DOCUMENTS

| | | | | | |
|---|---|---|---|---|---|
| 1,888,070 | A | * | 11/1932 | Buechner | 174/50.61 |
| 2,100,187 | A | * | 11/1937 | Handrek | 174/50.61 |
| 2,429,955 | A | * | 10/1947 | Goldsmith | 174/50.61 |
| 2,780,715 | A | * | 2/1957 | Strokes | 219/541 |
| 2,903,826 | A | * | 9/1959 | Monack | 174/50.61 |
| 3,199,967 | A | * | 8/1965 | Pixley | 174/50.61 |
| 3,296,505 | A | * | 1/1967 | Sparrow et al. | 174/50.61 |
| 3,810,734 | A | * | 5/1974 | Willson | 431/258 |
| 4,003,014 | A | * | 1/1977 | Branson et al. | 338/326 |
| 4,029,936 | A | * | 6/1977 | Schweitzer | 219/267 |
| RE29,853 | E | | 11/1978 | Perl | 219/270 |
| 4,176,903 | A | * | 12/1979 | Cairo et al. | 439/620 |
| 4,260,872 | A | * | 4/1981 | Brodmann et al. | 219/270 |
| 4,613,167 | A | * | 9/1986 | Okahashi et al. | 285/54 |
| 4,671,058 | A | * | 6/1987 | Yoshida et al. | 338/317 |
| 5,191,508 | A | * | 3/1993 | Axelson et al. | 361/257 |
| 5,564,618 | A | | 10/1996 | Axelson | 228/124.1 |
| 5,678,300 | A | * | 10/1997 | Saur et al. | 29/611 |
| 5,804,796 | A | * | 9/1998 | Kanesaka | 219/263 |
| 5,866,882 | A | * | 2/1999 | Saur et al. | 219/541 |
| 6,078,028 | A | * | 6/2000 | Cooper et al. | 219/270 |

FOREIGN PATENT DOCUMENTS

| | | | |
|---|---|---|---|
| DE | 19516080 | * | 11/1996 |
| JP | 2-75189 | * | 3/1989 |
| JP | 2-75187 | * | 3/1990 |
| JP | 7-55146 A | | 3/1995 |

* cited by examiner

*Primary Examiner*—John A. Jeffery
(74) *Attorney, Agent, or Firm*—Mike W. Crosby; Peter F. Corless; Edwards & Angell, LLP

(57) ABSTRACT

Robust ceramic igniters are provided that include an improved sealing system which can significantly enhance operational life of the igniter. Preferred igniters comprise a conductive cold zone and hot zone with higher resisitivity. A hermetic sealant material covers one or more electrical connections on the of each cold zone, thus shielding the electrical connections from environmental exposure, and thereby avoiding igniter failure resulting from electrical shorts and/or undesired oxidation.

36 Claims, 5 Drawing Sheets

CERAMIC IGNITERS WITH SEALED ELECTRICAL CONTACT PORTION

The present application claims the benefit of U.S. provisional application No. 60/313,113, filed Aug. 18, 2001, which is incorporated herein by reference in its entirety.

FIELD OF THE INVENTION

The invention relates generally to ceramic igniters and, more particularly, to ceramic igniters that contain improved sealing for electrical contact portions of the device.

BACKGROUND

Ceramic igniters have found increased use in certain ignition applications such as gas fired furnaces, stoves and clothes dryers. See, generally, U.S. Pat. Nos. 3,875,477, 3,928,910, 3,974,106, 4,260,872, 4,634,837, 4,804,823, 4,912,305, 5,085,237, 5,191,508, 5,233,166, 5,378,956, 5,405,237, 5,543,180, 5,785,911, 5,786,565, 5,801,361, 5,820,789, 5,892,201, 6,028,292, and 6,078,028.

While ceramic igniter designs and performance have improved, problems still exist that can prevent optimal functioning. One persistant problem is pentration of moisture or other fluids into the igniter electrical lead or contact portion, i.e. where electrical contacts mate with the igniter element, typically via a lead frame.

Penetrating fluids can originate from a variety of sources, including moisture from the surrounding area and the ambient atmosphere as well as liquid fuels such as kerosone that the ceramic element ignites.

Cooking evironments are especially problematic. Ceramic igniters used in gas stove settings frequently come into contact with spilled or splashed fluids (e.g. liquids, steam, etc.) emanating from pots or other apparatus on the stove.

Protective housing elements, particularly used in combination with a potting cement material (often an epoxy-based sealant), have been employed to avoid such fluid penetration, but such housings have not consistently provided satisfactory results. If fluid penetrates the igniter's protective housing, and contacts the electric leads therewithin, the igniter can short circuit and fail. Fluid penetration also can accelerate oxidation of the protected lead portion, which can result in premature igniter failure.

It thus would be desirable to have new ceramic igniters that could provide enhanced performance properties. It would be particularly desirable to have new ceramic igniters that have enhanced resistance to undesired fluid penetration and/or oxidation of the igniter's electrical contact portion.

SUMMARY OF THE INVENTION

We now provide new ceramic igniters that can exhibit significantly enhanced resistance to undesired moisture and/or oxygen penetration.

Preferred igniters of the invention are coated with or otherwise comprise at least in part a material that effectively inhibits entry of moisture and/or oxygen to an igniter's electrical contact portion. These coating compositions are generally referred to herein as a hermetic sealant material or composition. The hermetic sealant material suitably surrounds the electrical lead contact portion (typically distal to the igniter's hot zone region) to thereby insulate the electrical contact portion from undesired fluid/environmental contact.

A preferred hermetic sealant composition is a ceramoplastic material, e.g. a glass/mica material. We have found that ceramoplastic materials can surprisingly provide significantly enhanced resistance to moisture penetration relative to other materials, such as prior potting compositions. See, for instance, the comparative results set forth in Example 2, which follows.

We also have found that use of a hermetic sealant material in accordance with the invention can enable manufacture of an igniter element with reduced cross-sectional profile. Igniters of such reduced dimensions can be useful in a variety of applications, including to retrofit gas burning apparatus designed for spark ignition.

Methods are also provided for manufacture of igniters of the invention, which include coating, particularly encapsulating, the electrical contact portion of an igniter with a sealant material in accordance with the invention. Suitably, the sealant material is applied to the igniter in an insert molding-type or batch-type process, i.e. where at least one igniter element, preferably a plurality of igniter elements, reside within a mold and a sealant composition is applied to the igniter electrical contact portion areas. An injection molding process also is preferred and can enable reduced manufacturing costs and times. Other approaches also are suitable, including transfer molding and compression molding.

In a preferred aspect, ceramic igniters of the invention may be produced as a unitary or integral structure with other devices. For instance, an igniter element may be formed in an integral structure with a sensing element (e.g. a gas flame sensor) where those elements (igniter and sensor) are molded as a single integral structure through use of a hermetic sealant composition alone or together with other molding material. Use of a hermetic sealant composition as the predominant molding composition is preferred because of the thermal stability of such material. Reference that the hermetic sealant composition is the predominant material used as the molding material means that the hermetic sealant composition is present in an amount of greater than about 50, 60, 70, 80 or 90 weight percent based on total weight of the molding composition employed.

In another preferred system, a ceramic igniter element is produced with a hermetic sealant composition as disclosed above. The formed element is adapted to mate with a sizing element, which element can provide a desired shape and size to the formed igniter element. By this approach, a single igniter element can be utilized in a variety of distinct applications and environments.

More particularly, an igniter element can be formed with the exposed surface of the hermetic sealant composition preferably comprising threads, keyway, or other engagement surfaces that can reliably nest or otherwise fit with or within larger structures (e.g. rounded or edged blocks) that provide desired external dimensions. That larger structure then can be mounted in a particular environment, such as a gas cooking or heating unit.

The invention also provides igniter elements that are adapted to receive electrical connections, particularly where an electrical connection can be releasably engaged with the igniter element. Such a "plug-in" configuration can enable a single igniter to be used with multiple, distinct electrical connection or leads. Suitably, a housing element that surrounds at least a bottom portion of an igniter element is adapted to receive an electrical connection, e.g. by a snap-fit or other releasable engagement of an electrical lead. That housing can be formed in whole or part with a hermetic sealant material, preferably with the hermetic sealant composition encasing at least the electrical contact portions of the igniter.

As mentioned above, prior igniter elements often have included a sealant housing (e.g. a ceramic block) that surrounds the igniter electrical contact portions. A potting cement, typically an epoxy material, has been applied to fill the housing and thereby encase the igniter electrical contact areas. The epoxy or other sealant is generally manually applied which can result in undesired voids that can facilitate fluid penetration into the device as well as compromise the device's aesthetic appearance.

In contrast, igniters of the invention do not require any such ceramic block, or other separate housing. Rather, the sealant composition itself can form an integral sealing member on the igniter, obviating the need for a separate housing unit. The absence of a separate housing unit also can provide an igniter system of smaller cross-sectional size and lower manufacturing cost.

Igniters of the invention will have significant utility in a large number of applications. In particular, igniters of the invention will be especially useful in in environments where fluid is frequently present, e.g. cooking environments such as to ignite a cooktop gas burner where regular exposure to fluids can occur.

Other aspects of the invention are disclosed infra.

DETAILED DESCRIPTION OF THE INVENTION

Figure 1:
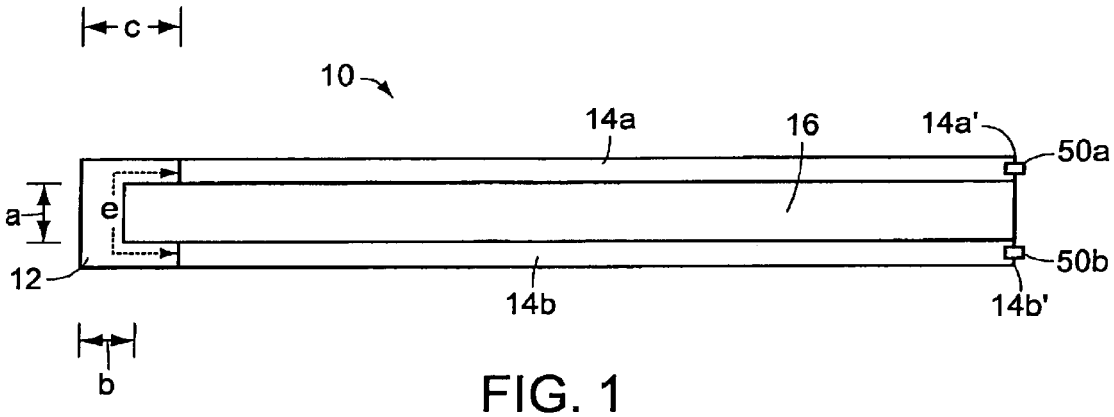
FIG. 1 depicts a hairpin-type ceramic igniter of the invention.

As discussed above, we now provide ceramic igniters that can exhibit significantly enhanced resistance to undesired moisture or other environemental infiltration. Electrical contact portions of of an igniter element are preferably coated at least in part with or otherwise comprise a hermetic sealant material, such as a ceramoplastic material.

We have found that incorporation of a hermetic sealant material in accordance with the invention not only renders the igniter moisture resistant/impervious, but also allows for a reduction in the overall dimensions of the igniter. This, in turn, enables the igniter to be more easily used in conjunction with, and/or retrofitted into, certain usage environments that previously may have been unavailable to ceramic igniters.

Preferred hermetic sealant materials for use in accordance with the invention exhibit extremely low moisture and/or oxygen penetration, e.g. exhibiting a porosity of approximately zero. A sealant material is considered herein to have a porosity of approximately zero of the sealant material shows (naked eye examination) minimal or essentially no pentration of a dye compound relative to prior potting compositions as determined by the procotol of Example 2 which follows. Such low porosity materials are generally referred to and designated to mean herein a "hermetic sealant material" or other similar term.

Preferred hermetic sealant materials are substantially inorganic compostions, i.e. the materials have minimal carbon content (e.g. less than 5, 10, 20 or 30 mole percent carbon) and preferably the composition is essentially or completely carbon-free (zero or less than one mole percent carbon). Preferred hermetic sealant compositions will exhibit thermal properties superior to most organic plastics, and have a wide temperature operation range, e.g. from about −400° F. to about 1400° F. Preferred hermetic sealant materials will have a high resistance to thermal degradation or deformation, e.g. the formed hermetic sealant material coating on an igniter element will not deform upon extended exposure (e.g. at least 0.5, 1, 2, 3 or 4 minutes, or at least 5, 6, 7, 8, 10, 12, 15, 20, 30 minutes) to temperatures such as at least about 350° C., more typically at least about 400° C. or 500° C., or even 550° C., 600° C., 650° C., 700° C., 750° C. or 800° C., as may result from the ignited gas or other fuel source. However, as discussed in detail below, hermetic sealant materials also can be employed that have lower thermal stabilities.

Igniters of the invention contain both hot and cold zone portions. The hot zone(s) are comprised of a sintered composition containing both a conductive material and an insulating material, as well as, optionally but typically, a semiconductor material. Conductive or cold zone portions of ceramic igniters of the present invention will contain a sintered composition of similar components as the hot zone(s) of the igniter, but with comparably higher concentrations of the conductive material.

Figure 2:
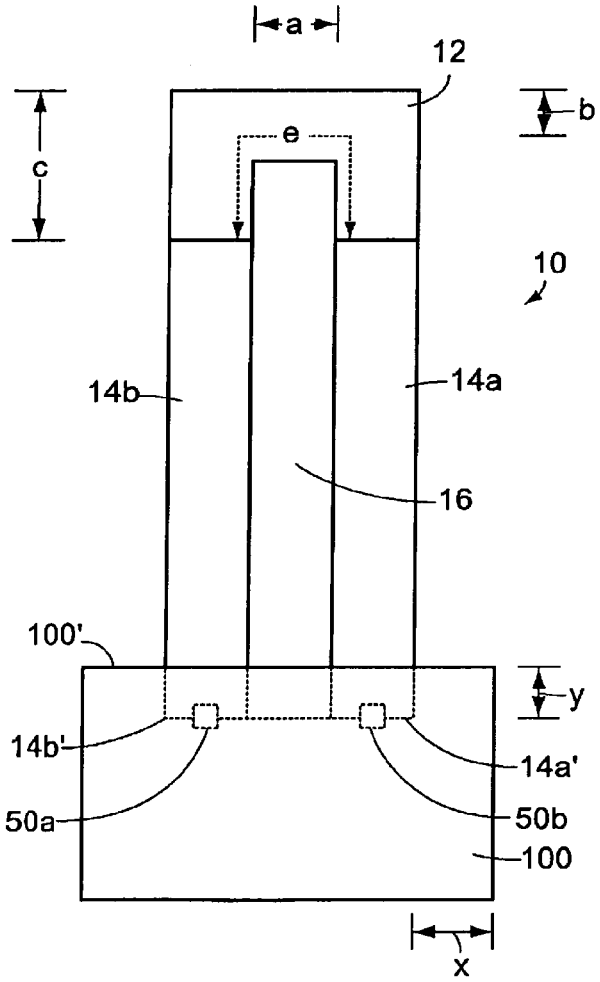
FIG. 2 depicts the igniter of FIG. 1 with its wire leads are covered with a sealant composition in accordance with the invention.

Referring now in detail to the drawings, FIGS. 1 and 2 depict an exemplary igniter 10 of the present invention that includes a hot zone portion 12 in contact with, and disposed between, cold zones 14*a* and 14*b*. Heat sink 16 is interposed between the cold zones 14*a* and 14*b* and is in contact with hot zone 12. Cold zone ends 14*a*' and 14*b*' are located distal from hot zone 12, and are in electrical connection to a power source (not shown) through leads 50*a*, 50*b* as is generally known in the art, typically through use of some type of lead frame mounting.

FIG. 2 depicts the igniter of FIG. 1 with protective hermetic sealant material barrier 100 surrounding the leads 50*a*, 50*b* located at the ends 14*a*', 14*b*' of the cold zones 14*a*, 14*b*. This barrier 100 should be made of a material that effectively prevents or significantly deters fluid from contacting leads 50*a*, 50*b*, but which does not adversely affect the connection between the leads 50*a*, 50*b* and a power source (not shown) to which the leads are electrically connected.

As discussed above, preferred heremetic sealant materials for use in accordance with the invention are inorganic materials that are not only excellent thermal and electrical insulators, but that also are impervious to moisture and/or oxygen (i.e., have a porosity of about zero) and that do not burn, outgas or carbonize.

As discussed above, a preferred hermetic barrier sealant material is a ceramoplastic composition, such as a glass bonded mica. A particularly preferred ceramoplastic sealant material is a glass bonded mica material available from the Saint-Gobain Company and has high thermal stability as discussed above. A further preferred ceramoplastic composition is commercially available from Mykroy/Mycalex Ceramics of Clifton, N.J., USA in sheet, rod, and custom fabricated/molded configurations of various grades. A specifically preferred material is Mykroy/Mycalex Grade 561-V (ceramoplastic material that is a moldable glass bonded to synthetic mica) available from Mykroy/Mycalex Ceramics of Clifton, N.J. That Mykroy/Mycalex Grade 561-V materials has a specific gravity of 3.2; nil moisture absorption; dielectric strength of 350 V/mil; tensil strength of 7500 psi; and Rockwell H hardness of 93. Suitable hermetic sealant material also may comprise Si.

Because of these materials properties, formation of the hermetic barrier 100 requires only a small amount of material in order to effectively protect the leads 50*a*, 50*b* from contacting any moisture. This, in turn, allows for a reduction in the overall dimensions of the igniter, thus enabling the igniter to be more easily used in conjunction with, and/or retrofitted into, certain usage environments that previously may have been unavailable to ceramic igniters.

More particularly, a relatively thin coating of a ceramoplastic material can be applied to an igniter element to provide effective sealing of the igniter electrical contacts. For instance, thickness x (i.e. distance from igniter outer surface to barrier layer 100 outer surface) as shown in FIG. 2 suitably can be less than about 3 mm, more preferably less than 2 mm, 1 mm, 0.5 mm, 0.3 mm, or even 0.2 mm, or 0.1 mm.

In this regard, preferred hermetic sealant materials will exhibit significantly greater dielectric strength (v/ml) than potting cement used in prior systems, which can facilitate use of thin coating layers. More particularly, preferred ceramoplastic materials can exhibit a dielectric strength (v/ml) at least about two times, more preferred at least about three times greater than prior potting cements.

The hermetic barrier coating also does not need to extend extensively along the length of the igniter element beyond the electrical contacts. For instance, distance y (i.e. distance from igniter bottom surface surface 14*a*' and 14*b*' to the top surface 100' of barrier 100) as shown in FIG. 2 suitably can be less than about 4 mm, more preferably less than about 3.5 mm, 3.0 mm, 2.5 mm or 2.0 mm, or even 1.0 mm.

A hermetic sealant composition also may be used in combination with other materials, including prior potting cements. For instance, a thin layer of a hermetic sealant material may be applied to encapsulate the electrical lead portions of an igniter element. That thin layer then may be coated with a distinct material that is preferably stable to high temperatures, but need not exhibit low levels of moisture and/or oxygen porosity. For instance, the hermetic sealant composition may be overcoated with a potting cement, such as an epoxy-based material, as has been employed in prior systems as the sole sealant.

Alternatively, a layer of a potting cement may be initially applied to the igniter electrical contact portions, which is then encapsulated or otherwise capped with a hermetic sealant material of the invention.

Such combined sealant composition systems can facilitate use of a hermetic sealant composition that has a lower thermal stability. That is, by use of an additional, distinct sealant that may not have extremely low porosity, but does have high thermal stability, hermetic sealant materials with a range of thermal stabilities may be effectively employed. By that design, the additional material (i.e. other than the hermetic sealant) satisfies the thermal stability requirements of the sealant unit.

Thus, hermetic sealant materials may be employed with relatively lower heat stabilities such as e.g. stability at about 300° C., 400° C., 500° C. or 600° C. before visibile (naked eye) degradation occurs upon one minute exposure to such temperature. A glass or glass/mica composite may be a suitable hermetic sealant material with such lower temperature stability. The additional, non-hermetic material should have a high thermal stability, such the ability to withstand prolonged (0.5 to 5 minutes) exposure to at least about 400° C., 500° C., 600° C., 700° C. or 800° C. without visible (naked eye) degradation.

In a preferred aspect of the invention, the exterior of the sealant unit (which may be the integral hermetic sealant composition) may be configured as desired. For instance, the exterior surface may be desagianed to facilitate attachment of the igniter element within a larger system such as a cookstove or the like, e.g. the exterior surface may be threaded or grooved to facilitate releaseably attachment of the formed igniter element. Such configured exterior surface can be readily provided through the molding manufacturing process as discussed above.

Figure 3:
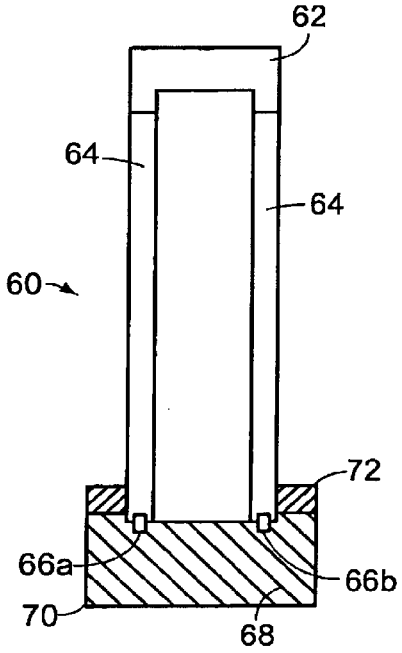
FIG. 3 shows a particular igniter design of the invention that includes a plurality of distinct sealant compositions.

FIG. 3 depicts such a system having a plurality of sealant compositions. Igniter 60 includes hot zone 62, cold zones 64 and leads 66*a* and 66*b* encased within an epoxy-based potting composition 68 which in turn is housed within rigid sealant housing 70. Hermetic sealant material 72 forms a type of seal or plug of the system, preventing moisture or other fluid to contact leads 66*a* and 66*b*.

As shown in FIG. 1, hot zone 12 may have a non-linear, substantially U-shaped electrical path length "e" (shown with dotted line to emphasize minimum path) that extends down the length of each side of the igniter. Such non-linear hot zone geometries are believed to more effectively diffuse power density throughout the hot zone region, and to enhance operational life of the igniter, and thus are generally preferred.

The dimensions of the hot zone region may suitably vary provided that the overall hot zone electrical path length is within the predetermined ranges disclosed herein. In the generally rectangular igniter design depicted in FIG. 1, the hot zone width between the cold zones (depicted as distance "a" in FIG. 1) should be sufficient to avoid electrical shorts or other defects. In one preferred system, that distance "a" is 0.5 cm.

The hot zone bridge height (depicted as distance "b" in FIG. 1) also should be of sufficient size to avoid igniter defects, including excessive localized heating, which can result in igniter degradation and failure as discussed above. For example, for the design depicted in FIG. 1, preferred hot zone bridge heights will be in the range of about 0.03 cm to about 0.5 cm. The term "hot zone bridge height" as used herein is understood to mean the dimension of a hot zone that extends parallel to the length or long dimension of a generally rectangular ceramic igniter, as exemplified by dimension "b" depicted in FIG. 1.

The hot zone "legs" that extend down the length of the igniter will be limited to a size sufficient to maintain the overall hot zone electrical path length to within about 2 cm.

The composition of the hot zone 12, cold zones 14*a*, 14*b* and heat sink 16 of a ceramic igniter of the present invention may suitably vary; however, suitable compositions for those regions are disclosed in U.S. Pat. No. 5,786,565 to Willkens et al. as well as in U.S. Pat. No. 5,191,508 to Axelson et al.

More particularly, the composition of the hot zone 12 should be such that the hot zone exhibits a high temperature (i.e. 1350° C.) resistivity of between about 0.01 ohm-cm and about 3.0 ohm-cm, and a room temperature resistivity of between about 0.01 ohm-cm and about 3 ohm-cm.

A preferred hot zone 12 contains a sintered composition of an electrically insulating material, a metallic conductor, and, in an optional yet preferred embodiment, a semiconductor material as well. As used herein, the term "electrically insulating material" or variations thereof refer to a material having a room temperature resistivity of at least about $10^{10}$ ohm-cm, while the terms "metallic conductor," "conductive material" and variations thereof signify a material that has a room temperature resistivity of less than about $10^{-2}$ ohm-cm, and the terms "semiconductive ceramic," "semiconductor material" or variations thereof denote a material having a room temperature resistivity of between about 10 and $10^8$ ohm-cm.

In general, an exemplary composition for a hot zone 12 of the ceramic igniter 10 includes (a) between about 50 and about 80 volume percent (vol % or v/o) of an electrically insulating material having a resistivity of at least about $10^{10}$ ohm-cm; (b) between about 5 and about 45 v/o of a semiconductive material having a resistivity of between about 10 and about $10^8$ ohm-cm; and (c) between about 5 and about 25 v/o of a metallic conductor having a resistivity of less than about $10^{-2}$ ohm-cm.

Preferably, the hot zone 12 comprises 50–70 v/o of the electrically insulating material, 10–45 v/o of the semiconductive ceramic, and 6–16 v/o of the conductive material.

Typically, the metallic conductor is selected from the group consisting of molybdenum disilicide, tungsten disilicide, and nitrides such as titanium nitride, and carbides such as titanium carbide, with molybdenum disilicide being a generally preferred metallic conductor. In certain preferred embodiments, the conductive material is $MoSi_2$, which is present in an amount of from about 9 to 15 vol % of the overall composition of the hot zone, more preferably from about 9 to 13 vol % of the overall composition of the hot zone.

Generally preferred semiconductor materials, when included as part of the overall composition of the hot 12 and cold zones 14*a*, 14*b* of the igniter 10, include, but are not limited to, carbides, particularly silicon carbide (doped and undoped), and boron carbide. Silicon carbide is a generally preferred semiconductor material for use in the ceramic igniter 10.

Suitable electrically insulating material components of hot zone compositions include, but are not limited to, one or more metal oxides such as aluminum oxide, a nitride such as a aluminum nitride, silicon nitride or boron nitride; a rare earth oxide (e.g., yttria); or a rare earth oxynitride. Aluminum nitride (AlN) and aluminum oxide ($Al_2O_3$) are generally preferred.

Particularly preferred hot zone compositions of the invention contain aluminum oxide and/or aluminum nitride, molybdenum disilicide, and silicon carbide. In at least certain embodiments, the molybdenum disilicide is preferably present in an amount of from 9 to 12 vol %.

As discussed above, igniters 10 of the invention typically also contain at least one or more low resistivity cold zone region 14*a*, 14*b* in electrical connection with the hot zone 12 to allow for attachment of wire leads 50*a*, 50*b* to the igniter. Typically, a hot zone 12 is disposed between two cold zones 14*a*, 14*b*, which are generally comprised of, e.g., AlN and/or $Al_2O_3$ or other insulating material; SiC or other semiconductor material; and $MoSi_2$ or other conductive material.

Preferably, cold zone regions 14*a*, 14*b* will have a significantly higher percentage of the conductive and/or semiconductive materials (e.g., SiC and $MoSi_2$) than are present the hot zone. Accordingly, cold zone regions 14*a*, 14*b* typically have only about ⅕ to 1/1000 of the resistivity of the hot-zone region 12, and do not rise in temperature to the levels of the hot zone. More preferred is where the cold zone(s) 14*a*, 14*b* room temperature resistivity is from 5 to 20 percent of the room temperature resistivity of the hot zone 12.

A preferred cold zone composition for use in igniter of the invention comprises about 15 to 65 v/o of aluminum oxide, aluminum nitride or other insulator material, and about 20 to 70 v/o $MoSi_2$ and SiC or other conductive and semiconductive material in a volume ratio of from about 1:1 to about 1:3. More preferably, the cold zones 14*a*, 14*b* comprise about 15 to 50 v/o of aluminum oxide and/or aluminum nitride, about 15 to 30 v/o SiC, and about 30 to 70 v/o $MoSi_2$. For ease of manufacture, the cold zone composition is preferably formed of the same materials as the hot zone composition, but with the relative amounts of semiconductive and conductive materials being greater in the cold zone(s) 14*a*, 14*b* than the hot zone(s) 12.

The electrically insulating heat sink 16 should be comprised of a composition that provides sufficient thermal mass to mitigate convective cooling of the hot zone 12. Additionally, when disposed as an insert between two conductive legs as exemplified by the system shown in FIG. 1, the heat sink 16 must provide mechanical support for the extended cold zone portions 14*a* and 14*b*, and must serve to make the igniter 10 more rugged.

In some embodiments, insert 16 may be provided with a slot (not shown) to reduce the mass of the system. Preferably, the electrically insulating heat sink 16 has a room temperature resistivity of at least about $10^4$ ohm-cm and a strength of at least about 150 MPa. More preferably, the heat sink material has a thermal conductivity that is not so high as to heat the entire heat sink 16 and transfer heat to the leads, and not so low as to negate its beneficial heat sink function.

Suitable ceramic compositions for the heat sink 16 include compositions comprising at least about 90 vol % of at least one of aluminum nitride, boron nitride, silicon nitride, alumina and mixtures thereof. Where a hot zone composition of AlN—$MoSi_2$—SiC is employed, a heat sink material comprising at least 90 vol % aluminum nitride and up to 10 vol % alumina can be preferred for compatible thermal expansion and densification characteristics. A preferred heat sink composition is disclosed in co-pending U.S. patent application Ser. No. 09/217,793, the entire disclosure of which is incorporated herein by reference.

Ceramic igniters 10 of the invention can be employed with a variety of voltages, including, but not limited to, nominal voltages of 6, 8, 12, 24, 120, 220, 230 or 240 volts. Preferred igniters of the invention can heat rapidly from room temperature to operational temperatures, e.g. to about 1350° C. in about 4 seconds or less, even 3 seconds or less, or even 2.75 or 2.5 second or less.

Preferred igniters 10 of the invention also can provide a stable ignition temperature with a hot zone power density (surface loading) of from 60 to 200 watts per $cm^2$ of the hot zone region.

Figure 4:
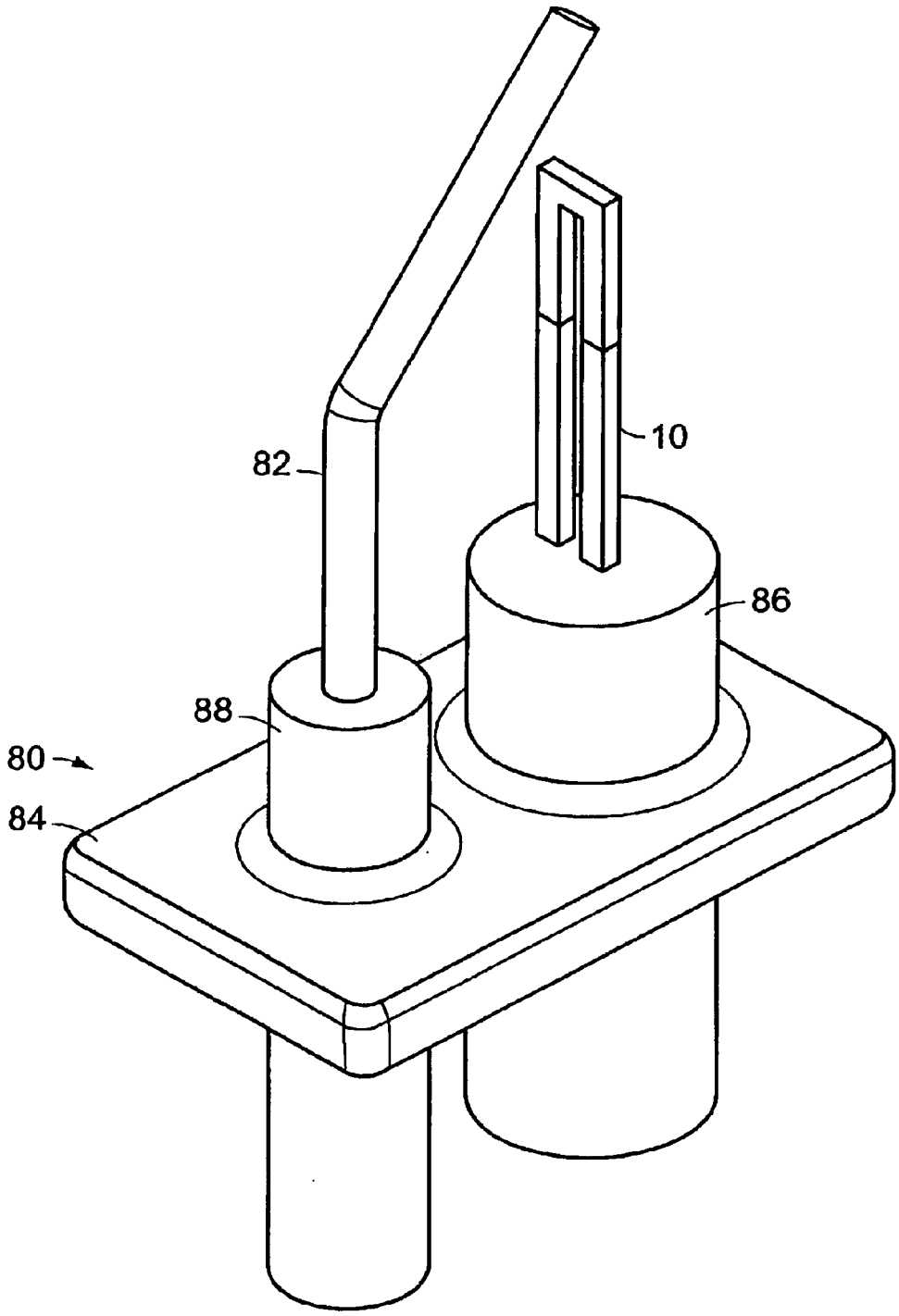
FIG. 4 shows a preferred integral structure that comprises both igniter and sensor elements.

FIG. 4 exemplifies a preferred system of the invention where an igniter element is formed in an integral structure (i.e. single molded, bonded or otherwise joined structure) with one or more other functioning or operational devices such as a sensor element. References herein to "an operational element" or other similar term indicates that the element can react to the environment or other input (e.g. electrical or thermal input) in some manner, typically by providing an output such as resistive heating, an electrical signal or the like. More specifically, as shown in FIG. 4, an integral structure 80 may contain igniter element 10 (shown as a slotted element) and an operational element of a sensor element 82 that can detect flame, heat or the like. Integral structure 80 can be a variety of configurations and is suitably adapted to fit within an intended usage environment. FIG. 4 shows a preferred configuration, where structure 80 includes planar surface 84 into which igniter 10 and sensor 82 are mounted through blocks 86 and 88 respectively. Structure 80 may be formed entirely or predominately from a hermetic sealant composition. Alternatively, structure 80 suitably may be formed with distinct materials, with the hermetic sealant composition being employed at least to encapsulant igniter end portions where contact is made with electrical leads. Materials other than a hermetic sealant composition suitable for forming structure 80 include e.g. an epoxy material.

Figure 5:
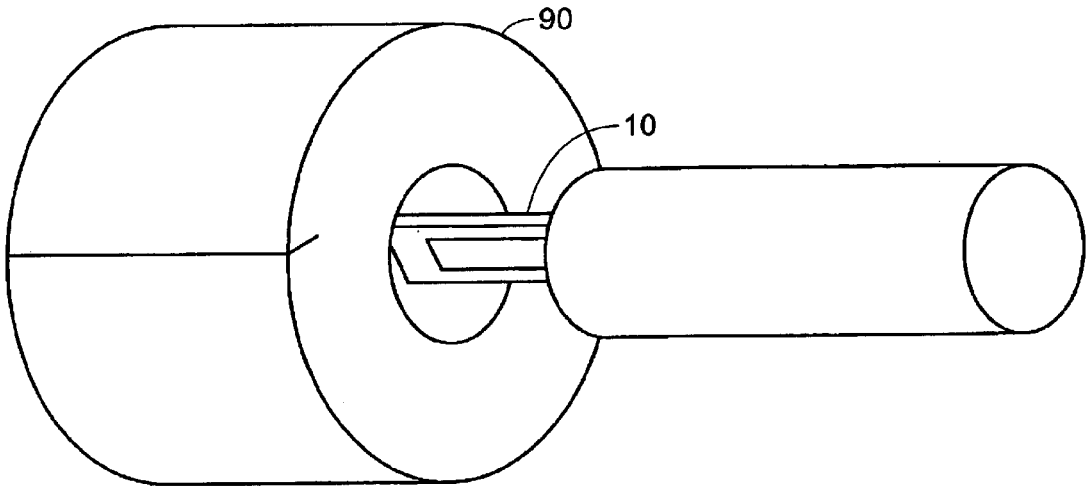
FIG. 5 shows a preferred igniter system of the invention.

FIG. 5 shows a preferred system of the invention where igniter 10 is mated with sizing element 90, which is depicted as a preferred oval-shaped element, although other configurations also will be suitable such as a squared block and the like. References herein to a "sizing element" or other similar term indicate that the element provides increased dimensions to an igniter element when mated (in physical contact) with the igniter element, e.g. increasing the width of the igniter element by about 10, 20, 30, 40, 50, 60, 70, 80 or 100 percent or more. In FIG. 5, the depicted element 90 includes a mating groove for securing the element within the usage environment. Igniter 10 suitably is press fit engaged within the sizing element, or otherwise secured therein, e.g. with an adhesive, threaded engagement and the like.

Figure 6:
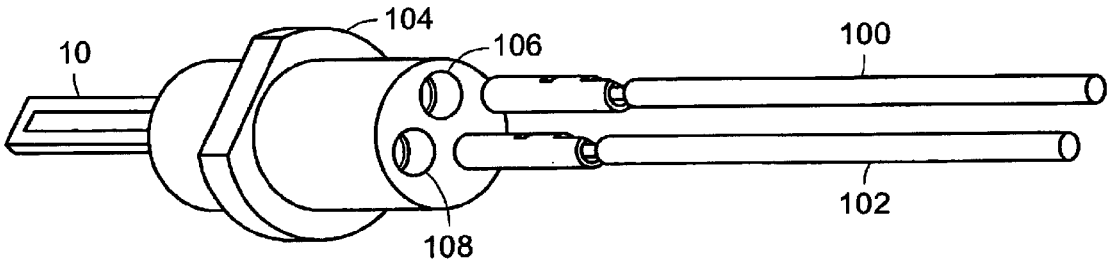
FIG. 6 shows a further preferred igniter system of the invention.

FIG. 6 shows a further preferred system of the invention where igniter element 10 is adapted to releasably receive electrical connection elements 100 and 102. Suitable electrical connections include electrical lead lines that provide electrical power to the igniter element during use thereof.

In the preferred system depicted in FIG. 6, connection elements 100 and 102 releasably secure to igniter housing portion 104 that includes electrical receiving portions 106 and 108. Those portions 106 and 108 receive connection elements 100 and 102 respectively and releasably retain them. The system depicted in FIG. 6 depicts a preferred groove (on connection elements 106 and 108) and flange (within housing 104, not shown in FIG. 6) securing system. Other engagement systems also will be suitable such as a threaded engagement. The connection elements can be removed and replaced with other connection elements (electrical leads) as desired.

Figure 7:
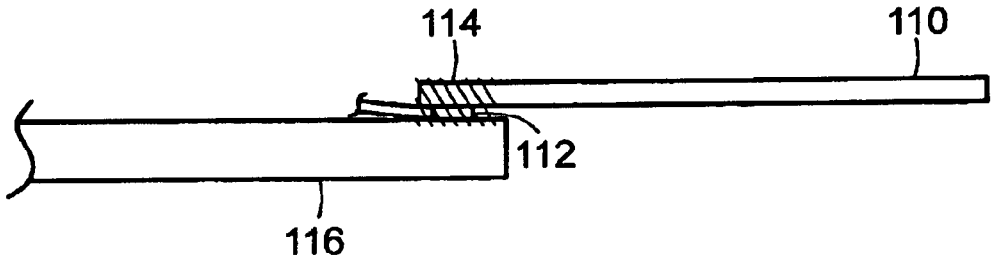
FIG. 7 shows a side view of an igniter together with a lead frame element.
Figure 8:
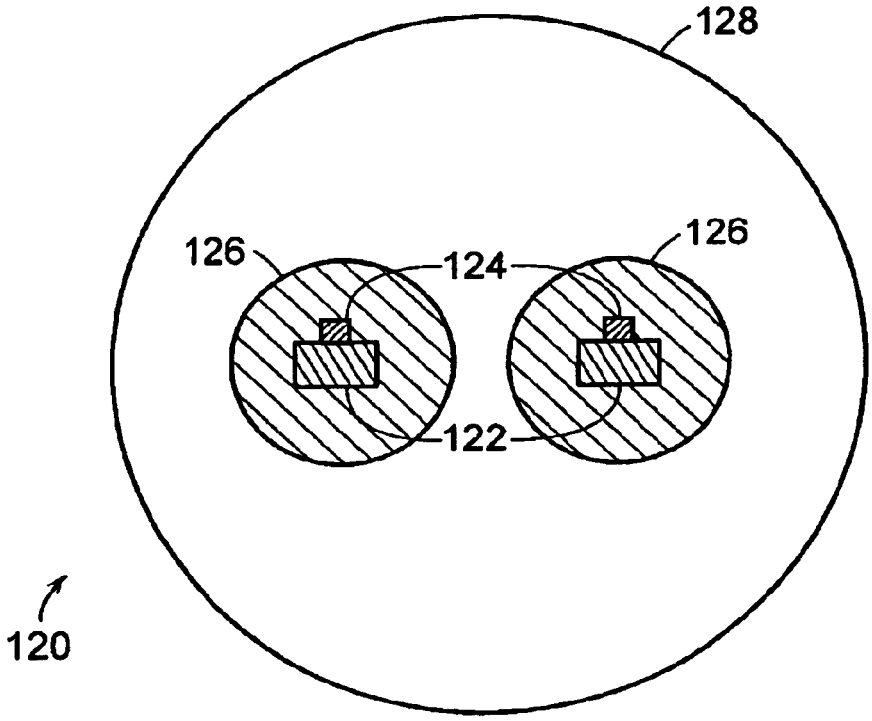
FIGS. 8 and 9 show cross-sectional views of an igniter system of the invention that include a hermetic sealant and a further sealant distinct from the hermetic sealant.
Figure 9:
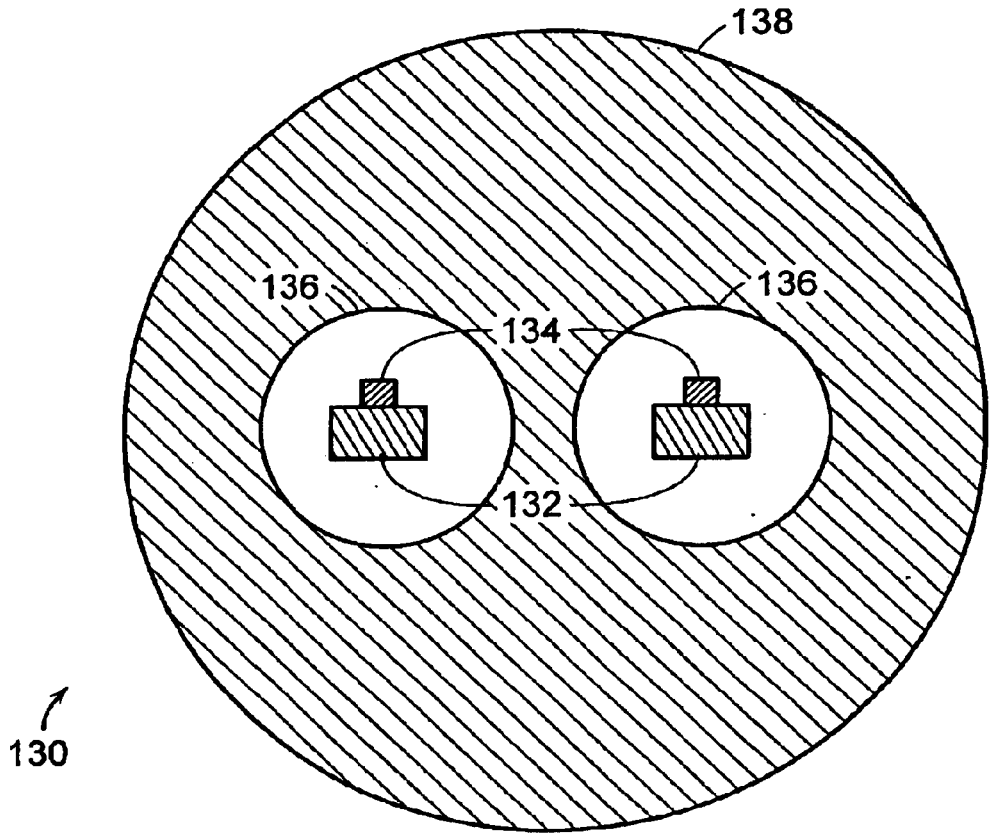

FIG. 7 shows a further system where igniter 110 with electrical connection 112 affixed to igniter conductive zone and coated with hermetic sealant 114 is mounted on a lead frame element 116, FIGS. 8 and 9 show in cross-sectional views igniter elements where an igniter element and an electrical connection thereof are coated with a hermetic sealant and an additional distinct sealant. More particularly, FIG. 8 shows U-shape igniter element 120 having conductive zone leg portions 122 with electrical connections 124 coated with a hermetic sealant composition 126 and coated thereover is a further sealant composition 128, distinct from hermetic sealant composition 126. FIG. 9 shows U-shaped igniter element 130 with conductive zone leg portions 132 having electrical connections 134 thereon coated with a first sealant composition 136 and coated thereover is coated a hermetic sealant composition 138, where the hermetic sealant 138 composition is distinct from the first sealant composition 136.

The processing of the ceramic component (i.e., green body processing and sintering conditions) and the preparation of the igniter 10 from the densified ceramic can be done by conventional methods. Typically, such methods are carried out in substantial accordance with U.S. Pat. No. 5,786,565 to Willkens et al. and U.S. Pat. No. 5,191,508 to Axelson et al., the disclosure of which are explicitly incorporated herein by reference.

Igniters can be produced in accordance with generally known procedures, such as disclosed in U.S. Pat. No. 5,405,237 to Washburn. See also Example 1 which follows, for illustrative conditions.

For example, a formed billet of green body igniters can be subjected to a first warm press (e.g. less than 1500° C. such as 1300° C.), followed by a second high temperature sintering (e.g. 1800° C. or 1850° C.). The first warm sintering provides a densification of about 65 or 70% relative to theoretical density, and the second higher temperature sintering provides a final densification of greater than 99% realtive to theoretical density.

In preferred igniter production methods a billet sheet is provided that comprises a plurality of affixed or physically attached "latent" igniter elements. The billet sheet has hot and cold zone compositions that are in a green state (not densified to greater than about 96% or 98% theoretical density), but preferably have been sintered to greater than about 40% or 50% theoretical density and suitably up to 90 ort 95% theoretical density, more preferably up to about 60 to 70% theoretical density. Such a partial densification is suitably achieved by a warm press treatment, e.g. less than 1500° C. such as 1300° C., for about 1 hour under pressure such as 3000 psi and under argon atmosphere.

It has been found that if the hot and cold zones compositions are densified at greater than 75 or 80 percent of theoretical density, the billet will be difficult to cut in subsequent processing steps. Additionally, if the hot and cold zones compositions are densified at less than about 50 percent, the compositions often degrade during subsequent processing. The hot zone portion extends across a portion of the thickness of the billet, with the balance being the cold zone.

The billet may be of a relatively wide variety of shapes and dimensions. Preferably, the billet is suitably substantially square, e.g. a 9 inch by 9 inch square, or other suitable dimensions or shapes such as rectangular, etc. The billet is then preferably cut into portions such as with a diamond cutting tool. Preferably those portions have substantially equal dimensions. For instance, with a 9 inch by 9 inch billet, preferably the billet is cut into thirds, where each of the resulting sections is 9 inches by 3 inches.

The billet is then further cut (suitably with a diamond cutting tool) to provide individual igniters. A first cut will be through the billet, to provide physical separation of one igniter element from an adjacent element. Alternating cuts will not be through the length of the billet material, to enable insertion of the insulating zone (heat sink) into each igniter. Each of the cuts (both through cuts and non-through cuts) may be spaced e.g. by about 0.2 inches.

After insertion of the heat sink zone, the igniters then can be further densified, preferably to greater than 99% of theoretical density. Such further sintering is preferably conducted at high temperatures, e.g. at or slightly above 1800° C., under a hot isostatic press.

The several cuts made into the billet can be suitably accomplished in an automated process, where the billet is positioned and cut by a cutting tool by an automated system, e.g. under computer control.

Once densified, electrical contacts are suitably applied to the cold region end of the igniter element, distal to hot zone regions, as generally depicted in FIGS. 1 and 2 above. The electrical contacts may be affixed to the igniter element by e.g. an adhesive. A lead frame is generally attached to each contact to enable communication with a power source.

Thereafter, the electrical contacts are coated, covered or encased with a sealant compositions as disclosed herein. Preferably, the sealant is applied to the igniter element by an insert molding process, where the igniter with the one or more electrical contacts thereon are positioned within a mold adapted to provide the encapsulating sealant portion. Sealant composition then may be added to the mold and cured to provide a seal or cap coating encasing the contacts.

As indicated above, igniters of the invention may be used in many applications, including gas phase fuel ignition applications such as furnaces and cooking appliances, baseboard heaters, boilers, and stove tops.

Igniters of the invention also may be employed in other applications, including for use as a heating element in a variety of systems. More particularly, an igniter of the invention can be utilized as an infrared radiation soruce (i.e. the hot zone provides an infrared output) e.g. as a heating element such as in a furnace or as a glow plug, in a monitoring or detection device including spectrometer devices, and the like.

The following non-limiting examples are illustrative of the invention. All documents mentioned herein are incorporated herein by reference in their entirety.

EXAMPLE 1

An igniter of the invention is suitably prepared as follows.

Hot zone and cold zone compositions were prepared for a first igniter. The hot zone composition comprised 70.8 volume % (based on total hot zone composition) AlN, 20 volume % (based on total hot zone composition) SiC, and 9.2 volume % (based on total hot zone composition) $MoSi_2$. The cold zone composition comprised 20 volume % (based on total cold zone composition) AlN, 20 volume % (based on total cold zone composition) SiC, and 60 volume % (based on total cold zone composition) $MoSi_2$. The cold zone composition was loaded into a hot die press die and the hot zone composition loaded on top of the cold zone composition in the same die. The combination of compositions was densified together under heat and pressure to provide the igniter.

EXAMPLE 2

Electrical contacts were applied with a braze joint to two essentially identical igniters produced as described above in Example 1. Those two igniters are referred to as Igniter A and Igniter B below.

Igniter A was further processed in accordance with the invention. Specifically, Igniter A with electrical contacts thereon was placed in a mold and a ceramoplastic material available from Mykroy/Mycalex Ceramics added to the mold to encapsulate the contacts to provide an element of the design generally represented in FIG. 2.

For Igniter B, a cylindrical ceramic housing element was placed around the electrical contacts. An epoxy sealant was added to fill the housing element and encapsulate the contacts. The epoxy sealant was allowed to dry to cure.

The encapsulated electrical contact ends of each of Igniters A and B were placed in colored penetrating dye for about ten minutes. Upon cross-section analysis by visual (naked eye) inspection, no fluid was absorbed into the ceramoplastic cap of Igniter A, while the fluid was extensively absorbed into the epoxy/ceramic-housing element of Igniter B.

The invention has been described in detail with reference to particular embodiments thereof. However, it will be appreciated that those skilled in the art, upon consideration of this disclosure, may make modifications and improvements within the spirit and scope of the invention.

What is claimed is:

1. A ceramic igniter comprising:

one or more electrical connections to the igniter element, the one or more electrical connections and igniter element having thereon a ceramoplastic hermetic sealant material, wherein the hermetic sealant material is stable upon exposure to 600° C. for at least 0.5 minutes.

2. The igniter element of claim 1 wherein the igniter comprises an electrically conductive portion; one or more electrical connections affixed to the conductive portion; and a hot zone in connection with and having greater resisitivity than the conductive portion.

3. The igniter element of claim 2 wherein an electrically non-conductive heat sink material contacts the hot zone.

4. The igniter element of claim 3 wherein the heat sink material is disposed between conductive portions.

5. The igniter element of claim 4 wherein each of the electrically conductive portions extends in the same direction from the hot zone to define a pair of legs, and the electrically non-conductive heat sink material is disposed between the legs.

6. The igniter element of claim 2 wherein the ratio of the room temperature resistivity of the hot zone is at least 1.5 times the room temperature resistivity of the cold zone portions.

7. The igniter element of claim 1 wherein the hermetic sealant material is stable to exposure to a temperature of about 400° C. for at least five minutes.

8. The igniter element of claim 1 wherein the hermetic sealant material is a substantially inorganic composition.

9. The igniter element of claim 1 wherein the hermetic sealant material comprises Si.

10. The igniter element of claim 1 wherein the hermetic sealant material comprises mica.

11. The igniter element of claim 1 wherein a lead frame is attached to each of the one or more electrical connections.

12. The igniter element of claim 11 wherein the hermetic sealant material covers the one or more connections and lead frames thereof.

13. The igniter element of claim 1 wherein the hermetic sealant material is applied by insert molding.

14. The igniter element of claim 1 wherein the hermetic sealant material has a thickness of less than about 3 mm.

15. The igniter element of claim 1 wherein the hermetic sealant material has a thickness of less than about 2 mm.

16. The igniter element of claim 1 wherein the hermetic sealant material is overcoated with a sealant composition distinct from the hermetic material.

17. The igniter element of claim 16 wherein the distinct sealant composition has a moisture and/or oxygen permeability greater than that of the hermetic sealant material.

18. The igniter element of claim 1 wherein the hermetic sealant material is coated over a sealant composition distinct from the hermetic material.

19. The igniter element of claim 18 wherein the distinct sealant composition is resistant to degradation upon exposure to a temperature of at least about 400° C. for more than 30 seconds.

20. The igniter element of claim 18 wherein the distinct sealant composition is a potting cement.

21. The igniter element of claim 18 wherein the distinct sealant composition comprises an epoxy material.

22. An igniter device comprising an igniter of claim 1 and a distinct operational element.

23. The igniter element of claim 22 wherein the distinct element is a sensor element.

24. The igniter device of claim 22 wherein an integral structure comprises the igniter and distinct element.

25. The igniter device of claim 24 wherein the integral structure is formed predominately from a hermetic sealant composition.

26. An igniter device comprising an igniter element of claim 1 adapted to mate with a sizing element.

27. The igniter device of claim 26 wherein the igniter element is threaded, bracketed or grooved for mating with the sizing element.

28. The igniter device of claim 26 the sizing element is an oval block element.

29. An igniter device comprising an igniter element of claim 1 adapted to receive an electrical connection.

30. The igniter device of claim 29 wherein the igniter comprises a housing that releasably secures the electrical connection.

31. The igniter device of claim 30 wherein the housing is formed at least in part from a hermetic sealant material.

32. The method of claim 1 wherein the hermetic sealant material does not deform upon exposure to 700° C. for at least 0.5 minutes.

33. The method of claim 1 wherein the hermetic sealant material does not deform upon exposure to 800° C. for at least one minute.

34. A method of igniting gaseous fuel, comprising:

applying an electric current across an igniter of claim 1.

35. A method for forming a ceramic igniter, comprising:

providing a sintered ceramic igniter element comprising one or more electrical connections to the igniter element;

applying a ceramoplastic hermetic sealant material to the igniter element, wherein the hermetic sealant material is stable upon exposure to 600° C. for at least 0.5 minutes.

36. The method of claim 35 wherein the hermetic sealant material covers the electrical connections.

* * * * *